US005179811A

United States Patent [19]

Walker et al.

[11] Patent Number: 5,179,811

[45] Date of Patent: Jan. 19, 1993

[54] DECORATIVE TRIMMING SYSTEM

[76] Inventors: William H. Walker, 2825 Cottonwood Dr., Marietta, Ga. 30066; Kenneth Braswell, 3315 Holliglen Dr., Marietta, Ga. 30062

[21] Appl. No.: 620,769

[22] Filed: Dec. 3, 1990

[51] Int. Cl.[5] ..... E04F 19/04

[52] U.S. Cl. ..... 52/287; 52/288; 52/718.02

[58] Field of Search ..... 52/287, 288, 716, 717, 52/718

[56] References Cited

U.S. PATENT DOCUMENTS 3,302,350 2/1967 Brown et al. ..... 52/287
4,642,957 2/1987 Edwards ..... 52/287

*Primary Examiner*—Richard E. Chilcot, Jr.
*Assistant Examiner*—Wynn Wood
*Attorney, Agent, or Firm*—Thomas, Kerr & Kayden

[57] ABSTRACT

An improved decorative trimming system for installing crown mold, baseboard and the like to a room includes elongated mounting brackets adapted to be secured along room walls extending about the room periphery. Each bracket include a projecting tongue that extends along the length of the bracket. Prefabricated corner pieces of molding are provided with longitudinal grooves extending along the back sides of their legs for receiving the tongues of the mounting brackets in snug fitting relationship. Similarly, straight lengths or strips of molding have grooves formed along their back sides also for receiving the tongues of the mounting brackets. In use, mounting brackets are secured along room walls extending about the room periphery and prefabricated corner pieces are pressed or snapped into position on the mounting brackets. Straight lengths of molding are cut and pressed into place between the ends of opposed corner pieces to finish out the trimming without the need for intricate mitering, coping, or other skills not usually possessed by the average homeowner or do-it-yourselfer.

14 Claims, 2 Drawing Sheets

DECORATIVE TRIMMING SYSTEM

TECHNICAL FIELD

This invention relates to decorative trim such as crown mold, chair rail and baseboard, and particularly to an improved system for applying such trim to a room accurately, quickly, and easily.

BACKGROUND OF THE INVENTION

Decorative trim such as, for example, crown mold, has been a popular enhancement to interior rooms of building structures for many years primarily because it tends to lend a more formal appearance to such rooms. In the past, such decorative trim was commonly sculpted in place by highly skilled trimming masons using plasters and other sculptable materials that could be applied wet, manually sculpted to a desired decorative shape and allowed to dry to form the finished trim. While this type of trim was often very ornate and beautiful, its creation obviously required a tremendous amount of effort by what could be entire teams of skilled plaster masons. Sculpted plaster trim thus tends to be extremely expensive and, consequently, is often found only in buildings constructed many years ago.

More recently, modern high speed wood molding machinery has made it possible to produce large quantities of highly ornate molded wooden trim quickly and economically. As a consequence, such wooden trim has become extremely popular and is used almost exclusively in modern construction for trimming out interior rooms of homes and other buildings. Even more recently, some decorative trim has been fabricated of various plastics using modern extrusion techniques. Plastic trim tends to be even more economical than wooden trim and is generally not subject to fluctuations in the supply and cost of lumber.

While molded wooden and extruded plastic trim has generally proven much simpler and less expensive to install than sculpted plaster trims of the past, its installation has nevertheless been plagued with numerous inherent problems and shortcomings that usually make successful installation too difficult for the average homeowner or do-it-yourselfer. Wooden crown mold, for example, is not always easy to orient properly along the top edge of a wall and can easily become cocked or canted, which is unsightly and tends to make it almost impossible to create acceptable corner joints. This is particularly true when the molding is secured to the walls with a hammer and nails since the impact of hammer blows can move and cock the molding as it is secured.

Even when the molding is oriented properly along the wall, creating crisp mitered looking corner joints at molding intersections can be difficult and usually requires the skills of an experienced coping carpenter who meticulously sculpts the ends of intersecting lengths of molding with a small coping saw to fit together and form the joint. Finally, even the joining of two or more lengths of molding to form an extended run along a wall in such a way that the resulting joints are not visible can be a difficult and frustrating task.

As a result of the difficulty of installing molded decorative trim, such installation has typically been beyond the skill of a home owner or "do-it-your-selfer" who must usually employ a professional trimming carpenter for the job. Further, even when installed by professionals, the tedious sizing, joining and coping of corners of the molding can require long hours of effort and, consequently, can be relatively expensive. A continuing and heretofore unaddressed need exists, therefore, for a decorative trimming system that is accurate, simple, quick, inexpensive, and easily applied by the average home owner or do-it-your-selfer. It is to the provision of such a trimming system that the present invention is primarily directed.

SUMMARY OF THE INVENTION

The present invention comprises an improved system for installing decorative trim quickly, easily, accurately, and with a minimum of required skill. More specifically, and with exemplary reference to the installation of crown mold, the system includes mounting brackets adapted to be secured in place along the top edges of the walls of a room adjacent the room's ceiling. The mounting brackets have front faces that are oriented with respect to the wall and ceiling at the proper angle for crown mold with the front faces being formed with a tongue that extends along the length of the bracket and protrudes from the front face thereof.

Molded trim for use with the system of this invention includes pre-fabricated unitary corner pieces of molding for installation in corners of the room and matching straight lengths of molding for installation along the walls of the room between opposed corner pieces. The legs of the corner pieces and the extended lengths of molding are all formed with a longitudinal groove that extends along their back sides with the groove being sized to receive the tongues of the mounting brackets in snug fitting relationship when the molding is pressed onto the mounting brackets.

In using the system of this invention to install, for example, crown mold, mounting brackets are secured with nails or the like along the top edges of the walls of a room with their angled tongued faces oriented toward the interior of the room. The mounting brackets can be installed quickly and without excessive care since they ultimately will be covered by the crown mold and thus will not show. With the mounting brackets in place, prefabricated corner pieces of crown mold are positioned in each corner of the room and simply pressed or snapped into place with the tongues of mounting brackets along adjacent walls being received snugly within the grooves formed along the back sides of each leg of the crown mold corner pieces. Small brads or nails can be used to attach the molding even more securely to the mounting brackets if desired.

With the corner pieces secured in position on the mounting brackets, the distance between the ends of the legs of opposed corner pieces is measured and straight lengths of matching molding cut to correspond to the measured lengths. The cut straight lengths of crown mold can then be secured in place by being positioned between the ends of corresponding opposed corner piece legs and pressed onto the mounting brackets. Since the mounting brackets accurately align and position both the corner pieces and the straight lengths extending therebetween, simple butt joints can be used in joining the corner pieces and straight lengths rather than the complex mitered joints often required in the past. The entire room is thus fitted with crown mold in a few simple steps that require very little skill and that can be performed quickly by the average home owner or do-it-your-selfer.

The system includes similar components for use in installing other types of trim such as chair rail and baseboard wherein mounting brackets are secured about the periphery of a room, prefabricated corner pieces are pressed into place on the mounting brackets and straight lengths of trim are cut for placement between opposed corner pieces. All types of decorative trim can thus be installed easily and quickly using the system of the present invention.

It is thus an object of the invention to provide an improved decorative trimming system that is simple to use and that requires a minimum level of skill.

Another object of the invention is to provide a decorative trimming system that does not require delicate coping or mitering of trim at the corners of a room.

A still further object of the invention is to provide an improved decorative trimming system that aligns and orients trim automatically.

An additional object of the invention is to provide an improved decorative trimming system wherein trim can be installed without the need for complex mitered or coped joints between adjacent pieces of the trim.

These and many other objects, features, and advantages of the invention will become more apparent upon review of the following detailed description taken in conjunction with the accompanying drawings.

DETAILED DESCRIPTION OF THE PREFERRED EMBODIMENTS

Figure 1:
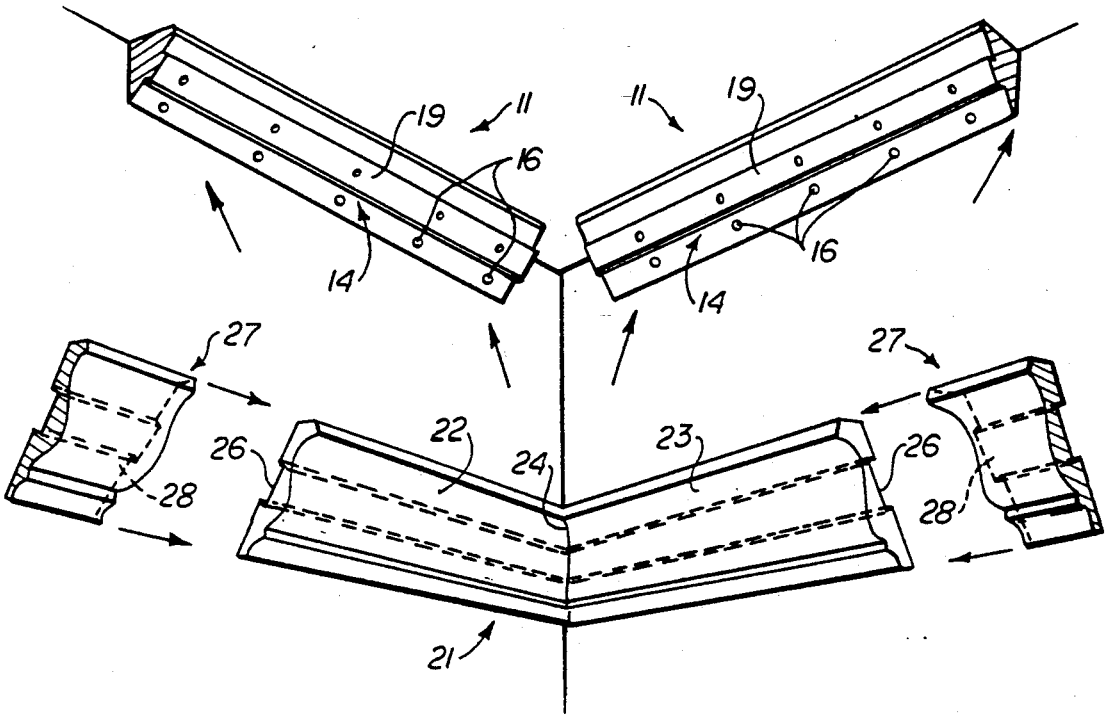
FIG. 1 is a perspective view of a system that embodies principles of the present invention in a preferred form for installing crown mold.
Figure 2:
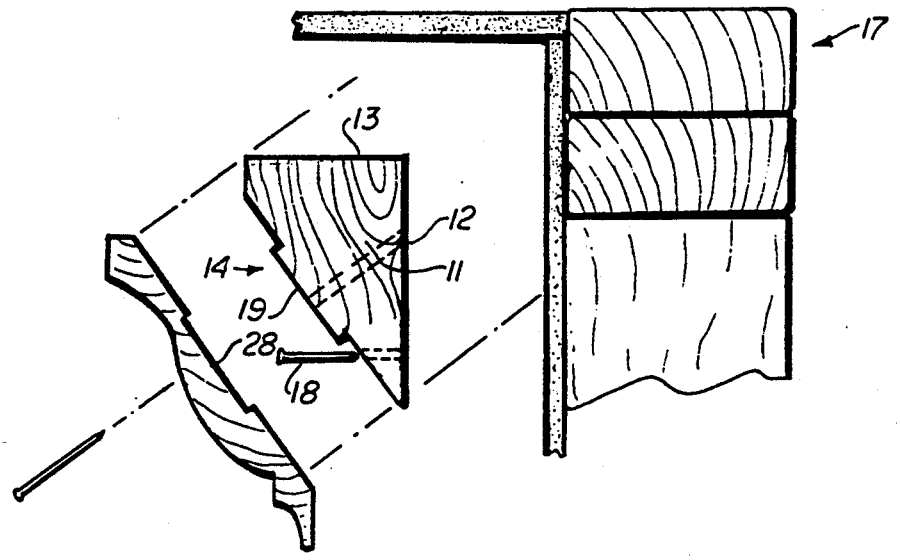
FIG. 2 is an exploded sectional view of the system illustrated in FIG. 1 showing relative placement of system components.
Figure 3:
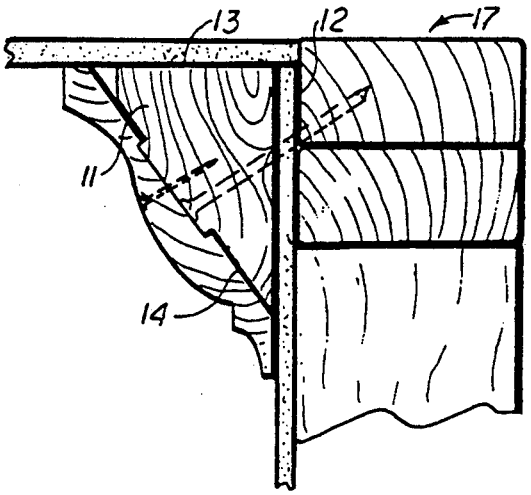
FIG. 3 is a sectional view of the system illustrated in FIG. 1 showing a mounting bracket secured to the wall and crown mold trim secured to the mounting brackets.

Referring now in more detail to the drawings, in which like numerals refer to like parts throughout the several views, FIGS. 1 through 4 illustrate the present invention in a preferred form for installation of crown mold trim around the top perimeter of a room adjacent its ceiling. FIG. 1 shows one upper corner of a room where two adjacent walls meet the ceiling. Secured to and extending along the upper edge of each wall is a mounting bracket 11 that is preferably formed of wood but that can be fabricated from plastic or other suitable materials. Each mounting bracket 11 is seen (FIGS. 2–4) to be formed with a substantially right triangular cross-sectional shape defining a rear face 12 of the bracket, a top face 13 of the bracket and a front face 14 of the bracket. As best seen in FIG. 3, the mounting brackets are installed with their rear faces 12 positioned against the wall of the room and with their top faces 13 positioned against the ceiling of the room.

The mounting brackets 11 are preferably provided with an array of holes 16 that are spaced and positioned along the bracket to align with the top plates 17 of the wall framing or with the vertical studs of the framing. In this regard, since most walls studs are spaced apart a distance of 16 inches, a preferred spacing of the holes 16 might, for example, be 4 inches. In this way, when the mounting bracket is longitudinally positioned to align one of the holes with a wall stud, then every fourth succeeding hole will also align with a stud. Nails 18 (FIG. 2) can then be hammered through the holes and into the wall framing to secure the mounting brackets in position.

The front face 14 of each mounting bracket 11 is oriented with respect to the wall and ceiling at the proper angle for the crown mold that is to be installed. The front face is further formed with a protruding tongue 19 that extends along the length of the mounting bracket intermediate the top and bottom edges of its front face. While the tongue 19 could be a separate element secured to the front face of the mounting bracket, it is preferred that the bracket itself be molded or otherwise formed with its tongue as a unitary part of the front face thereof. Furthermore, while the tongue is illustrated in FIG. 1 as extending to the end of each of the mounting brackets 11, it will be understood that the end portions of the brackets may be formed without tongues for purposes detailed hereinbelow.

A prefabricated corner piece 21 of crown mold has left and right legs 22 and 23 that extend at substantially right angles with respect to each other and that are securely joined together at the proper angled orientation by a mitered or coped joint 24. In this regard, it is preferred that the joint 24 be coped rather than simply mitered to provide some flexibility of adjustment of the corner piece without opening a significant gap at the joint 24. In this way, the corner piece can accommodate rooms that may not be perfectly square while preserving the crisp mitered-looking joint at the corner.

The back sides of the left and right legs 22 and 23 are formed with longitudinally extending grooves 26. The grooves 26 are shaped, sized, and configured to receive the tongues 19 of the mounting brackets 11 in a snug fitting relationship when the corner piece is positioned in the room corner and pressed onto the mounting brackets. In this regard, the grooves 26 can be formed with slightly inwardly beveled edge walls if desired or, conversely, the tongues 19 can be formed with slightly beveled opposed edges. In this way, the tongue becomes wedged and thus tightly held in the groove as the molding is pressed onto the bracket.

Lengths of straight crown mold 27 are formed with a front side molded to match the front sides of the corner piece legs and with a back side that also includes a longitudinally extending groove 28. As with the legs of the corner piece 21, the grooves 28 are configured and positioned to receive the tongues 19 of mounting brackets 11 in snug fitting relationship so that the lengths of molding 27 can be securely pressed into place on the brackets extending between opposed corner pieces as detailed hereinbelow.

Figure 4:
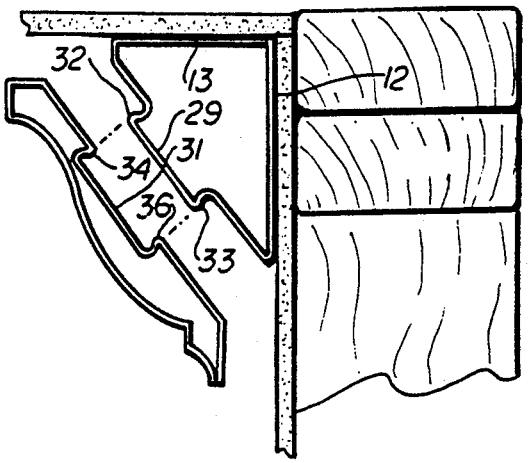
FIG. 4 illustrates an alternate embodiment of the system of FIG. 1 wherein the tongue of the mounting bracket and the groove of the trim are configured for mutual snapping engagement.

FIG. 4 illustrates an alternate embodiment of the just described system for use primarily with trim made of extruded plastic rather than wood, although this embodiment might also be adapted for wooden molding. In this embodiment, the front face 14 of the mounting bracket 11 is formed with a protruding tongue 29 that has opposed edges shaped to define sculpted outwardly extending lips 32 and 33. The back side of the crown mold 27 is formed with a corresponding groove 31 that has opposed notched edges 34 and 36 corresponding to the lips 32 and 33 of the tongue 29. With this embodiment, the tongue 29 is received and securely held within the groove 31 with the lips 32 and 33 nestled within the notches 34 and 36 so that the crown molding can be "snapped" and thereafter securely held in position on the mounting bracket 11.

Figure 5:
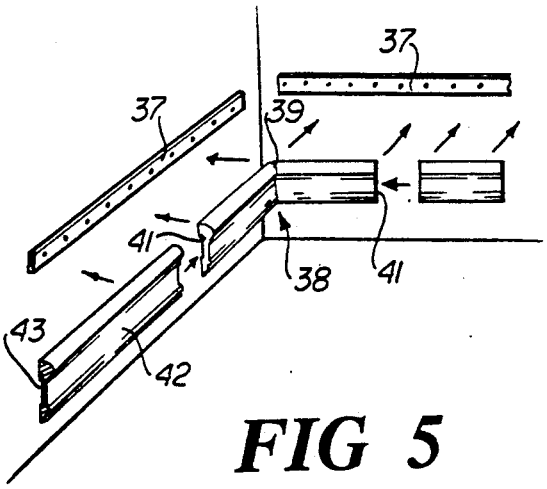
FIG. 5 illustrates an embodiment of the system for installation of chair rail.

FIG. 5 illustrates the system of the present invention for use with chair rail trim that is generally applied around the walls of a room about ⅓ of the way from the floor to the ceiling. With this embodiment, mounting brackets 37 in the form of elongated strips are secured along the walls extending about the periphery of a room as shown. Prefabricated corner pieces 38 of chair rail trim are formed with a crisp mitered or coped joint 39 with each leg of the corner piece having a back side formed with a longitudinally extending groove 41. Straight lengths of chair rail 42 are provided and have back sides that are also formed with a longitudinally extending groove 43. As with the previous embodiment, the grooves 41 and 43 are formed to receive the strips that form the mounting brackets 37 in snug fitting or snapping relationship so that the chair rail pieces can be securely pressed or snapped onto the brackets 37 and thus secured to the wall.

Figure 6:
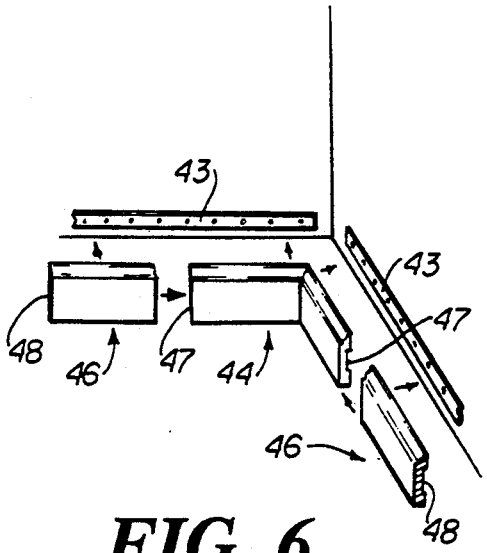
FIG. 6 illustrates an embodiment of the system for installation of baseboard.

FIG. 6 illustrates the system of this invention in a third embodiment for installation of baseboard type trim. As with the chair rail, mounting brackets 43 are secured along the bottoms of adjacent walls for receiving prefabricated baseboard corner pieces 44 and straight lengths of baseboard 46. As with previous embodiments, the baseboard is formed with its backside having grooves 47 and 48 for receiving the mounting brackets 43 in snug fitting or snapping relationship for securing the baseboard to the wall.

Figure 7:
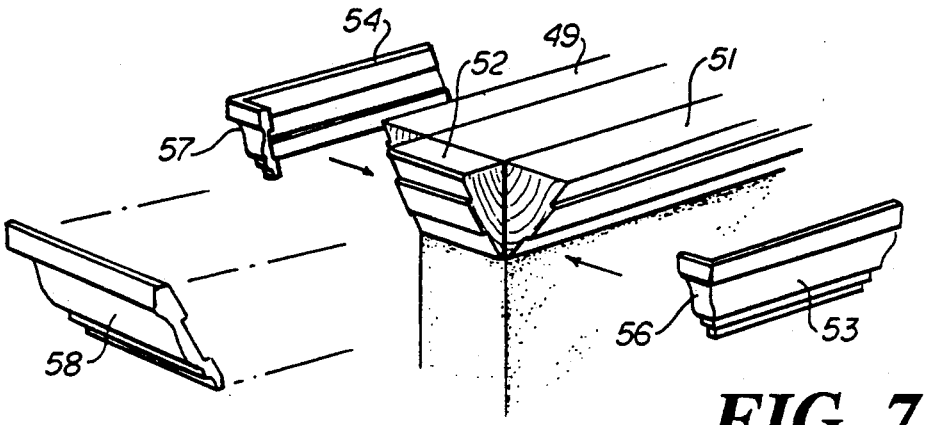
FIG. 7 illustrates an embodiment of the invention for installation crown mold around the end of a wing wall.

FIG. 7 shows an embodiment of the system for installing crown mold around the top end of a free standing or wing wall. With this embodiment, mounting brackets 49 and 51 are secured along opposed faces of the wall and a short mounting bracket 52 is secured at the top of the wall end. Strips 53 and 54 of molding are formed with preattached mitered end pieces 56 and 57 respectively that extend beyond the end of the wall when the molding strips 53 and 54 are secured in place on the mounting brackets 49 and 51. A bridge strip 58 of molding can be then secured to the mounting block 52 spanning the gap between end pieces 56 and 57 to complete the crown mold framing of the top of the wing wall.

OPERATION

In applying the system of this invention for installing decorative trim, appropriate mounting brackets are secured in place along the wall extending around the periphery of a room by means of nails or other suitable attachment. Prefabricated corner pieces of molding are then simply snapped or pressed into place at the corners of the room with the tongues of the mounting brackets being received and securely held within the grooves of the corner piece legs. Alternatively, where the bracket ends are formed without tongues as mentioned above, the corner pieces can be mounted to the brackets with small nails or adhesive. This method of installing corner pieces can be advantageous in situations where the walls of a room are out of square.

With all corner pieces in place, the distance between ends of opposed corner piece legs can be measured and a straight strip of molding cut that corresponds to or just slightly exceeds the measured length. The cut strip can then be bowed slightly, positioned between the opposed corner pieces and pressed securely into place on the mounting brackets. Cutting the straight strips slightly longer than the measured distance between opposed corner pieces insures a tight joint between the corner piece end and the straight piece end that later can be finished in the usual way to render it virtually invisible. In this regard, the mounting bracket tends to hold the adjacent pieces of molding at precisely the same angle with respect to the wall so that the butt joints tend to be virtually invisible, particularly after finishing. Small brads or nails can be used if desired to mount the molding even more securely to its mounting brackets.

With the molding thus installed, any joints that are visible can be treated with a small amount of caulking or putty in the usual way whereupon the molding can be painted, stained or otherwise finished. The result is a superior trimming job that rivals that of the most skilled artisans but that requires only a fraction of the time, effort, and skill needed to install trimming in the usual way. The system of this invention can thus readily be used by a homeowner or do-it-your-selfer to install professional looking decorative trim quickly, easily and relatively inexpensively.

The invention has been described in terms of preferred embodiments. It will be obvious to those of skill in the art, however, that many modifications might be made to the illustrated embodiments within the scope of the invention. For example, a tongue and groove system for mounting molding to mounting brackets has been illustrated. Obviously, many other types of mounting means might be used including spaced pins and corresponding receptacles, parallel ridges and corresponding grooves, and many more. Any specific configuration for securing the molding to its corresponding mounting brackets is therefore contemplated by this invention. Furthermore, while only inside corner pieces have been illustrated specifically in the preferred embodiments, it will be clear that outside corner pieces employing principles of the invention might also be provided as an integral part of the system. These and many other modifications, additions, and deletions might well be made to the preferred embodiments without departing from the spirit and scope of the invention as set forth in the claims.

We claim:

1. An improved decorative trimming system for applying molded trim about the periphery of a room with said decorative trimming system comprising:

bracket means adapted to be secured to the walls of the room extending about a periphery thereof, said bracket means having first and second wall contacting surfaces oriented at an angle to each other, each of said wall contacting surfaces having a front edge, said bracket means further including a surface member extending between the front edges of said wall contacting surfaces at an angle thereto, said surface member having trim mounting means thereon intermediate said front edges of said wall contacting surfaces;

at least one prefabricated corner piece of decorative trim having a first leg and a second leg with said corner piece being adapted to extend around a corner of the room, each of said first and second legs of said corner piece having first and second wall engaging surfaces and a rear face extending between said wall engaging surfaces at an angle thereto corresponding to the angle of said surface member of said bracket means, said rear face having mounting means thereon intermediate said engaging surfaces adapted to engage said trim mounting means;

at least one substantially straight length of decorative trim having first and second wall engaging surfaces and a rear face extending between said engaging surfaces at an angle thereto corresponding to the angle of said surface member, said rear face having mounting means thereon intermediate said engaging surfaces adapted to engage said trim mounting means for mounting and securing said straight length of decorative trim abutting and extending from an end of said first leg of said corner piece;

whereby the bracket means can be secured to the walls of the room extending around a periphery thereof whereupon the corner piece can be mounted to the bracket means in a corner of the room and the straight length can be mounted to the bracket means extending from the corner piece to trim the room.

2. The decorative trimming system of claim 1 and wherein said trim mounting means includes a tongue member protruding from and extending at least partially along the length of said surface member of said bracket means and said mounting means includes a groove formed in and extending along said rear face of each of said first and second legs of said corner piece, said tongue member and said groove being configured and positioned to mate and bind together when said corner piece is pressed into the room corner onto said bracket means.

3. The decorative trimming system of claim 2 and wherein said grooves are formed with opposed sides that are tapered to receive said tongue member in snug fitting relationship when said corner piece is pressed onto said bracket means.

4. The decorative trimming system of claim 2 and wherein said tongue member is formed with opposed sides that are tapered to be received into said grooves in snug fitting relationship when said corner piece is pressed onto said bracket means.

5. The decorative trimming system of claim 2 and wherein said tongue member is formed with opposed lips extending along opposed edges thereof and said grooves are formed with side edges configured to receive said lips in mutually nested relationship whereby the tongue member is snappingly received into the grooves of the corner piece when the corner piece is pressed onto said bracket means.

6. The decorative trimming system of claim 1 and wherein the molded trim is crown mold and wherein said bracket means is adapted to be secured about the upper periphery of the room adjacent the ceiling with said surface member of said bracket means being angled with respect to the walls and ceiling to receive and secure the crown mold in its proper angled orientation.

7. The decorative trimming system of claim 6 and wherein said trim mounting means includes a tongue protruding from and extending along said surface member of said bracket means and said mounting means includes a corresponding groove formed in said rear face of each of said first and second legs of said corner piece of crown mold and in said rear surface of said straight length of crown mold, said tongue and said grooves being configured and positioned to mate and bind together to secure said crown mold to said bracket means when said crown mold is pressed onto said bracket means.

8. The decorative trimming system of claim 7 and wherein said tongue is formed with opposed side edges that are tapered to be received into said grooves in snug fitting relationship when said crown mold is pressed onto said bracket means.

9. The decorative trimming system of claim 7 and wherein said grooves are formed with opposed side edges that are tapered to receive said tongue in snug fitting relationship when said crown mold is pressed onto said bracket means.

10. The decorative trimming system of claim 7 and wherein said tongue and said grooves are configured to snap together when said crown mold is pressed onto said bracket means.

11. A method of applying decorative trim about a preselected periphery of a room with said method comprising the steps of:

(a) securing a mounting bracket to the walls of the room extending about the preselected periphery;

(b) mounting prefabricated corner pieces of trim to the mounting bracket in the corners of the room;

(c) measuring the distance between distal ends of the legs of opposed corner pieces;

(d) cutting straight pieces of trim to have lengths corresponding substantially to the measured distances;

(e) positioning the straight pieces of trim between distal ends of the legs of opposed corner pieces; and (f) mounting the straight pieces of trim onto said mounting brackets;

wherein the mounting bracket includes a protruding tongue and the decorative trim is formed with a groove configured and positioned to receive the tongue in securely mated relationship when the trim is pressed onto the mounting bracket and wherein steps (b) and (f) comprise pressing the corner pieces and straight pieces into position onto said mounting bracket.

12. The method of claim 11 and wherein step (d) includes cutting the straight pieces of trim to lengths slightly greater than the corresponding measured distances.

13. The method of claim 12 and wherein step (e) includes bowing the straight pieces slightly outwardly as they are positioned between opposed corner pieces.

14. A system for application of decorative trim around a preselected periphery of a room with said system comprising lengths of decorative trim including prefabricated corner pieces of trim and bracket means adapted to be secured about the preselected periphery with said bracket means being configured to receive and securely hold said lengths of decorative trim in position extending about the preselected periphery, said corner pieces having legs configured to be received by and secured to said bracket means, said bracket means being formed with a tongue and said lengths of decorative trim being formed with a corresponding groove and wherein said tongue is received into said groove in secure mating relationship when said decorative trim is pressed onto said bracket means.

* * * * *